US007494116B2

(12) United States Patent
Terao et al.

(10) Patent No.: US 7,494,116 B2
(45) Date of Patent: Feb. 24, 2009

(54) SHEET POST-PROCESS SYSTEM AND SHEET POST-PROCESSING METHOD

(75) Inventors: Yasunobu Terao, Shizuoka-ken (JP); Yoshiaki Sugizaki, Shizuoka-ken (JP); Mikio Yamamoto, Shizuoka-ken (JP); Tomomi Iijima, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/976,140

(22) Filed: Oct. 22, 2007

(65) Prior Publication Data

US 2008/0061490 A1 Mar. 13, 2008

Related U.S. Application Data

(63) Continuation of application No. 11/085,240, filed on Mar. 22, 2005, now Pat. No. 7,344,131.

(30) Foreign Application Priority Data

Sep. 29, 2004 (JP) ..... 2004-285285

(51) Int. Cl.
*B65H 37/04* (2006.01)

(52) U.S. Cl. ..... 270/37; 270/32; 270/58.07; 270/58.08; 270/58.09; 270/58.12; 270/58.14; 270/58; 270/18

(58) Field of Classification Search ..... 270/32, 270/37, 58.07, 58.08, 58.09, 58.11, 58.12, 270/58.14, 58.18
See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,667,208 | A | 5/1987 | Shiraki et al. |
| 4,794,859 | A | 1/1989 | Huseby et al. |
| 4,849,796 | A | 7/1989 | Murakami |

(Continued)

FOREIGN PATENT DOCUMENTS

| | | | |
|---|---|---|---|
| JP | 60-023250 | A | 2/1985 |

(Continued)

OTHER PUBLICATIONS

Y. Terao et al., Notice of Allowance and Fee(s) Due, U.S. Appl. No. 11/008,199, filed Jan. 16, 2008, 8 pages.

(Continued)

*Primary Examiner*—Gene Crawford
*Assistant Examiner*—Leslie A Nicholson, III
(74) *Attorney, Agent, or Firm*—Foley & Lardner LLP

(57) ABSTRACT

Above a processing tray, a standby tray for making sheets of paper P stand by is installed. The sheets of paper P on the standby tray are dropped, fed, and moved to the processing tray, thus the conveying path from the standby tray to the processing tray is shortened. Furthermore, a Z-folding mechanism is arranged above the standby tray, and the sheets of paper P folded in a Z shape are dropped, and are mixed and stapled on the standby tray or processing tray, and even when performing a plurality of post processes for sheets, miniaturization of a sheet post-process system is retained.

8 Claims, 11 Drawing heets

U.S. PATENT DOCUMENTS 4,878,656 A 11/1989 Honjo et al.
4,898,374 A 2/1990 Vermaat
4,917,366 A 4/1990 Murakami et al.
5,020,784 A 6/1991 Asami et al.
5,021,837 A 6/1991 Uto et al.
5,098,074 A 3/1992 Mandel et al.
5,282,611 A 2/1994 Ueda et al.
5,285,249 A 2/1994 Mahoney
5,289,251 A 2/1994 Mandel et al.
5,337,134 A 8/1994 Sato et al.
5,370,384 A 12/1994 Romanowski
5,418,606 A 5/1995 Kikuchi et al.
5,435,544 A 7/1995 Mandel
5,449,157 A 9/1995 Kawano et al.
5,451,037 A 9/1995 Lundstrom
5,590,871 A 1/1997 Okabe et al.
5,622,359 A 4/1997 Kawano et al.
5,628,502 A 5/1997 Amarakoon
5,640,232 A 6/1997 Miyake et al.
5,676,517 A 10/1997 Lotz
5,709,376 A 1/1998 Ushirogata
5,767,884 A 6/1998 Bortolotti et al.
5,934,140 A 8/1999 Jackson et al.
5,961,274 A 10/1999 Bors
5,971,384 A 10/1999 Asao
6,022,011 A 2/2000 Hirose
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A 11/2000 Arai
6,146,085 A 11/2000 Namba et al.
6,179,287 B1 1/2001 Watanabe et al.
6,231,039 B1 5/2001 Chung
6,330,999 B2 12/2001 Coombs et al.
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 9/2002 Coombs
6,505,829 B2 1/2003 Kawata
6,581,922 B2 6/2003 Kuwata et al.
6,600,885 B2 7/2003 Kida
6,641,129 B2 11/2003 Ogita et al.
6,659,455 B2 12/2003 Endo et al.
6,671,492 B2 12/2003 Mimura et al.
6,674,983 B2 1/2004 Enomoto et al.
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 11/2004 Nagata et al.
6,848,685 B2 2/2005 Katsuyama
6,871,042 B2 3/2005 Nemura et al.
6,910,686 B2 6/2005 Awano
6,928,259 B2 8/2005 Sakuma
6,988,728 B2 1/2006 Kida
7,104,538 B1 9/2006 Kimura et al.
2002/0047233 A1 4/2002 Coombs et al.
2002/0053766 A1 5/2002 Kubota
2002/0074708 A1 6/2002 Nagata et al.
2002/0163119 A1 11/2002 Kawata
2003/0057625 A1 3/2003 Kuwata et al.
2003/0155705 A1 8/2003 Sekiyama et al.
2003/0214090 A1 11/2003 Kato et al.
2004/0032073 A1 2/2004 Sasamoto
2004/0126163 A1 7/2004 Asami et al.
2004/0181308 A1 9/2004 Hayashi et al.
2005/0000336 A1 1/2005 Hattori et al.

FOREIGN PATENT DOCUMENTS

JP 61-078162 U 5/1986
JP 61-108588 A 5/1986
JP 61-021481 Y2 6/1986
JP 61-166470 A 7/1986
JP 62-008965 A 1/1987
JP 62-229126 A 10/1987
JP 63-035756 U 3/1988
JP 63-154578 A 6/1988
JP 63-180673 A 7/1988
JP 02-055369 A 2/1990
JP 03-088667 A 4/1991
JP 04-125248 A 4/1992
JP 04-079857 U 7/1992
JP 04-312894 A 11/1992
JP 04-354756 A 12/1992
JP 05-238103 A 9/1993
JP 06-064815 A 3/1994
JP 06-083132 A 3/1994
JP 06-094324 B2 11/1994
JP 06-099070 B2 12/1994
JP 08-026558 A 1/1996
JP 08-259073 A 10/1996
JP 09-124216 A 5/1997
JP 09-216772 A 8/1997
JP 09-309659 A 12/1997
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-157729 A 6/1999
JP 11-208967 A 8/1999
JP 11-231753 A 8/1999
JP 11-301912 A 11/1999
JP 2000-095420 A 4/2000
JP 2000-159414 A 6/2000
JP 2001-048411 A 2/2001
JP 2001-089009 A 4/2001
JP 2001-316029 A 11/2001
JP 2002-060118 A 2/2002
JP 2002-308509 A 10/2002
JP 2002-321862 A 11/2002
JP 2002-362825 A 12/2002
JP 2003-081517 A 3/2003
JP 2003-171057 A 6/2003
JP 2003-192210 A 7/2003
JP 2003-246536 A 9/2003
JP 2003-335450 A 11/2003
JP 2004-142868 A 5/2004

OTHER PUBLICATIONS

Y. Terao et al., U.S. PTO Office Action, U.S. Appl. No. 11/008,224, filed Dec. 14, 2007, 9 pages.
Y. Terao et al., U.S. PTO Office Action, U.S. Appl. No. 11/826,731, filed Jan. 14, 2008, 7 pages.
U.S. Appl. No. 11/008,122, filed Dec. 10, 2004, Sasahara.
U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.

U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iisuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
C. Iizuka et al., U.S. PTO Office Action, U.S. Appl. No. 11/085,251, filed Jun. 25, 2007, 28 pgs.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,131, filed Sep. 26, 2007, 12 pages.
Y. Terao et al., Notice of Allowance and Fee(s) Due, U.S. Appl. No. 11/008,132, filed Jun. 1, 2007, 11 pages.
Y. Terao et al., Notice of Allowance and Fee(s) Due, U.S. Appl. No. 11/008,132, filed Oct. 6, 2005, 9 pages.
Y. Terao et al., Notice of Allowance and Fee(s) Due, U.S. Appl. No. 11/008,142, filed Jan. 5, 2007, 24 pages.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/008,290, filed Aug. 2, 2007, 9 pages.
Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,294, filed Jun. 14, 2007, 6 pgs.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,299, filed Jul. 23, 2007, 10 pages.
Y. Terao et al., Notice of Allowance and Fee(s) Due, U.S. Appl. No. 11/008,349, filed May 2, 2005, 9 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,381, filed Jun. 29, 2007, 6 pgs.
Y. Terao et al., Notice of Allowance and Fee(s) Due, U.S. Appl. No. 11/008,392, filed Sep. 15, 2006, 10 pages.
Y. Terao et al., Notice of Allowance and Fee(s) Due, U.S. Appl. No. 11/008,567, filed Mar. 1, 2007, 6 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., Notice of Allowance and Fee(s) Due, U.S. Appl. No. 11/085,244, filed Jul. 13, 2006, 10 pages.
Y. Terao et al., Notice of Allowance and Fee(s) Due, U.S. Appl. No. 11/085,247, filed Feb. 28, 2007, 14 pages.
Y. Terao et al., Notice of Allowance and Fee(s) Due, U.S. Appl. No. 11/085,248, filed Aug. 16, 2007, 8 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,131, filed Oct. 17, 2006, 15 pages.
Y. Terao et al., U.S. PTO Office Action, U.S. Appl. No. 11/008,132, filed Jun. 9, 2006, with attached Notice of Withdrawal from Issue dated May 30, 2006, 11 pgs.
Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,145, filed Jun. 30, 2006, 6 pgs,
Y. Terao et al., U.S. PTO Office Action, U.S. Appl. No. 11/008,147, filed Jul. 7, 2006, 4 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,199, filed Aug. 30, 2007, 18 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,224, filed Aug. 28, 2007, 8 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/008,230, filed Nov. 13, 2006, 17 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/008,248, filed Aug. 22, 2007, 8 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, 004-25-2006, 14 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Jul. 21, 2006, 15 pgs.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,294, filed May 5, 2006, 13 pages.

Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,295, filed Jun. 23, 2006, 14 pgs.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,392, filed Apr. 26, 2006, 10 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/008,567, filed Aug. 21, 2006, 14 pages.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,226, filed Jan. 29, 2007, 6 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,242, filed Jul. 10, 2007, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,248, filed Oct. 24, 2006, 12 pages.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,257, filed Jul. 16, 2007, 12 pgs.
Y. Terao et al., U.S. PTO Office Action, U.S. Appl. No. 11/085,264, filed Sep. 12, 2007, 16 pages.
Y. Terao et al., U.S. PTO Office Action, U.S. Appl. No. 11/085,625, filed Jul. 10, 2007, 11 pgs.
Y. Terao et al., U.S. PTO Office Action, U.S. Appl. No. 11/085,625, filed Jul. 28, 2006, 13 pgs.
Y. Terao et al., U.S. PTO Office Action, U.S. Appl. No. 11/085,625, filed Nov. 21, 2006, 13 pages.
Y. Terao et al., U.S. PTO Office Action, U.S. Appl. No. 11/822,611, filed Sep. 25, 2007, 20 pages.
Y. Terao et al., U.S. PTO Office Action, U.S. Appl. No. 11/826,731, filed Sep. 13, 2007, 21 pages.
Y. Terao et al., U.S. PTO Office Action, U.S. Appl. No. 11/008,290, filed Mar. 9, 2007, 8 pages.
Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13, 2005, 9 pages.
Y. Terao et al., U.S. PTO Office Action, U.S. Appl. No. 11/008,349, filed Dec. 13, 2005, 9 pages.
Y. Terao et al., U.S. PTO Office Action, U.S. Appl. No. 11/008,567, filed Dec. 13, 2005, 9 pages.
Y. Terao et al., U.S. PTO Office Action, U.S. Appl. No. 11/085,242, filed Mar. 23, 2007, 20 pages.
Y. Terao et al., U.S. PTO Office Action, U.S. Appl. No. 11/085,248, filed Apr. 10, 2007, 12 pages.
Y. Terao et al., U.S. PTO Office Action, U.S. Appl. No. 11/085,257, filed Mar. 23, 2007, 23 pages.
Y. Terao et al., U.S. PTO Office Action, U.S. Appl. No. 11/085,264, filed Mar. 23, 2007, 21 pages.
Y. Terao, et al., Notice of Allowance and Fee(s) Due, U.S. Appl. No. 11/008,122, filed Jul. 26, 2006, 8 pgs.
Y. Terao, et al., Notice of Allowance and Fee(s) Due, U.S. Appl. No. 11/008,124, filed Sep. 30, 2005, 9 pages.
Y. Terao, et al., Notice of Allowance and Fee(s) Due, U.S. Appl. No. 11/008,222, filed Aug. 31, 2006, 12 pgs.
Y. Terao, et al., Notice of Allowance and Fee(s) Due, U.S. Appl. No. 11/008,257, filed Oct. 24, 2006, 11 pgs.
Y. Terao, et al., Notice of Allowance and Fee(s) Due, U.S. Appl. No. 11/008,299, filed Sep. 6, 2006, 9 pgs.
C. Iizuka et al., U.S. PTO Office, U.S. Appl. No. 11/085,251, filed Oct. 16, 2007, 10 pages.
Y. Terao et al., Notice of Allowance and Fee(s) Due, U.S. Appl. No. 11/085,242, filed Nov. 7, 2007, 10 pages.
Y. Terao et al., Notice of Allowance and Fee(s) Due, U.S. Appl. No. 11/085,257, filed Oct. 31, 2007, 8 pages.
Y. Terao et al., U.S. PTO Office, U.S. Appl. No. 11/085,250, filed Nov. 20, 2007, 13 pages.
Y. Terao et al., U.S. PTO Office, U.S. Appl. No. 11/085,625, filed Nov. 2, 2007, 11 pages.
Y. Terao et al., Notice of Allowance and Fee(s) Due, U.S. Appl. No. 11/826,731, filed Jun. 13, 2008, 5 pages.
C. Iizuka et al., Notice of Allowance and Fee(s) Due, U.S. Appl. No. 11/085,251, filed Apr. 3, 2008, 8 pages.
Y. Terao et al., Notice of Allowance and Fee(s) Due, U.S. Appl. No. 11/008,248, filed Apr. 7, 2008, 11 pages.
Y. Terao et al., U.S. PTO Office Action, U.S. Appl. No. 11/008,224, filed Apr. 14, 2008, 7 pgs.
Y. Terao et al., U.S. PTO Office Action, U.S. Appl. No. 11/085,250, filed Apr. 10, 2008, 7 pgs.
Y. Terao et al., U.S. PTO Office Action, U.S. Appl. No. 11/822,611, filed Apr. 21, 2008, 18 pgs.
Y. Terao et al., Notice of Allowance and Fee(s) Due, U.S. Appl. No. 11/008,224, Sep. 11, 2008, 9 pages.

SHEET POST-PROCESS SYSTEM AND SHEET POST-PROCESSING METHOD

CROSS-REFERENCE TO RELATED APPLICATION

The present application is a continuation of U.S. application Ser. No. 11/085,240, filed Mar. 22, 2005, the entire contents of which is incorporated herein by reference.

This application is based upon and claims the benefit of priority from prior Japanese Patent Application No. 2004-285285 filed on Sep. 29, 2004, the entire contents of which are incorporated herein by reference.

BACKGROUND OF THE INVENTION

1. Field of the Invention

The present invention relates to a sheet post-process system and a sheet post-processing method for post-processing sheets of paper ejected from an image forming apparatus such as a copier, a printer, or a composite device.

2. Description of the Related Art

In recent years, in an image forming apparatus, to post-process sheets of paper after image forming such as sorting or stapling sheets of paper, a sheet post-process apparatus may be installed in the neighborhood of the paper ejection unit of the image forming apparatus body. To make succeeding sheets ejected from the image forming apparatus body stand by like this, conventionally, in Japanese Patent Publication 6-99070, an apparatus installing a shifting path halfway the path toward a stapler is disclosed. Further, in Japanese Patent Publication 6-83132, an image forming apparatus for matching a sheet of paper on which an image is formed on an intermediate tray and then re-sending it toward image forming is disclosed.

However, as in the conventional apparatus, when a shifting path is installed halfway the path toward the stapler, the length of the conveying path from the paper ejection section of the image forming apparatus body to the stapler becomes longer, thus a problem arises that miniaturization of the apparatus is disturbed.

Therefore, a sheet post-process system and a sheet post-processing method capable of shortening the distance from the paper ejection section of the image forming apparatus to the processing mechanism for performing the post process and realizing miniaturization are desired.

SUMMARY OF THE INVENTION

An object of this embodiment of the present invention is to provide a sheet post-process system and a sheet post-processing method for shortening the distance from the paper ejection section of the image forming apparatus to the processing mechanism for performing the post process and realizing miniaturization of the image forming apparatus.

According to this embodiment of the present invention, the sheet post-process system comprises a first processing mechanism for performing a first post-process for sheets ejected from the image forming apparatus, a standby tray for making sheets ejected from the image forming apparatus and/or sheets ejected from the first processing mechanism stand by, a gate for branching the sheets ejected from the image forming apparatus to either of the first processing mechanism and the standby tray, a processing tray arranged under the standby tray for loading the sheets dropped and fed from the standby tray and the sheets ejected from the image forming apparatus or the first processing mechanism not via the standby tray, a second processing mechanism for performing a second post process for the plurality of sheets loaded on the processing tray, and a paper ejection tray for at least loading the sheets ejected from the processing tray after ending of the second post process.

DETAILED DESCRIPTION OF THE INVENTION

Figure 1:
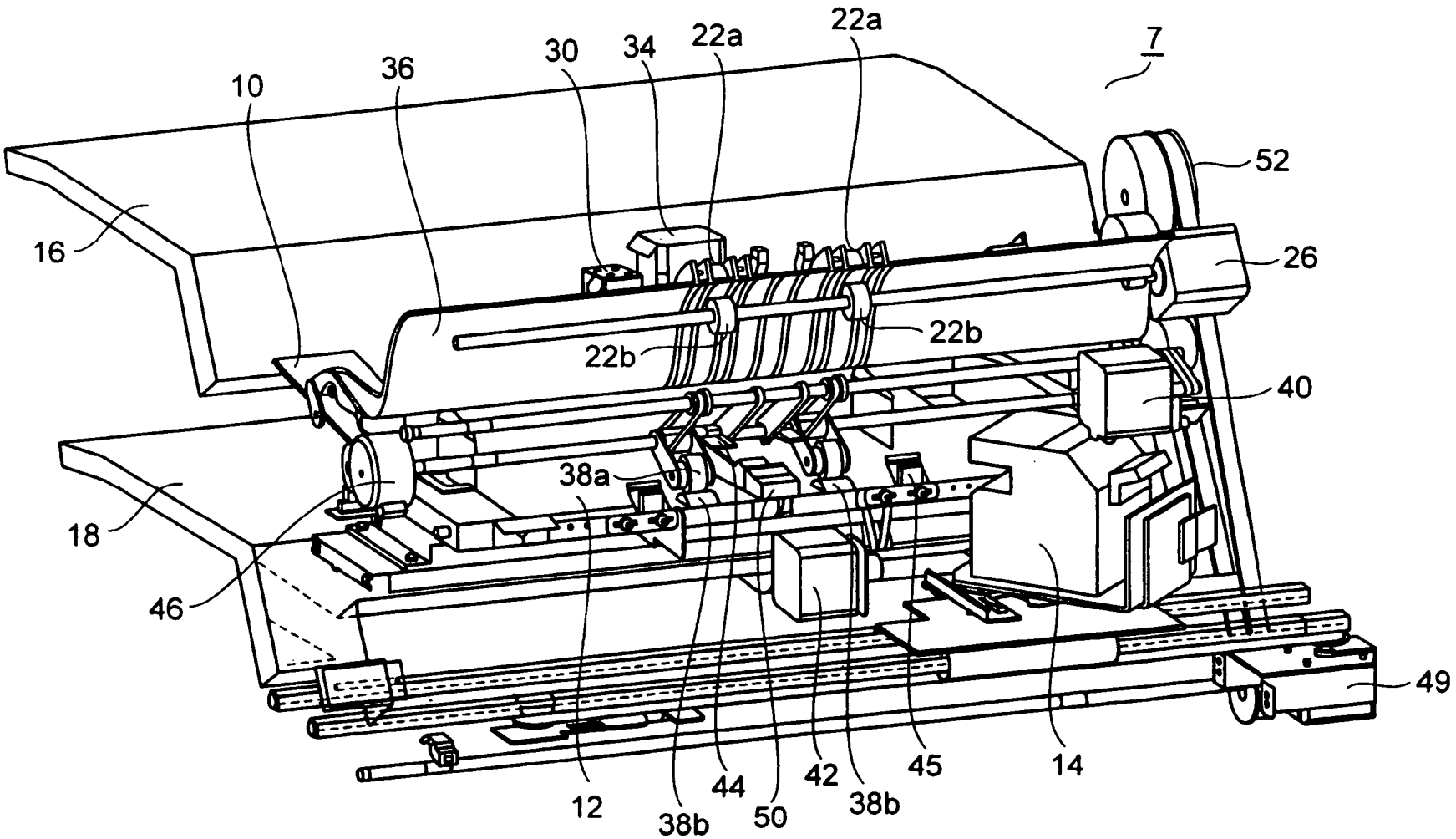
FIG. 1 is a perspective view showing the essential section of the sheet post-process apparatus of the embodiment of the present invention.
Figure 2:
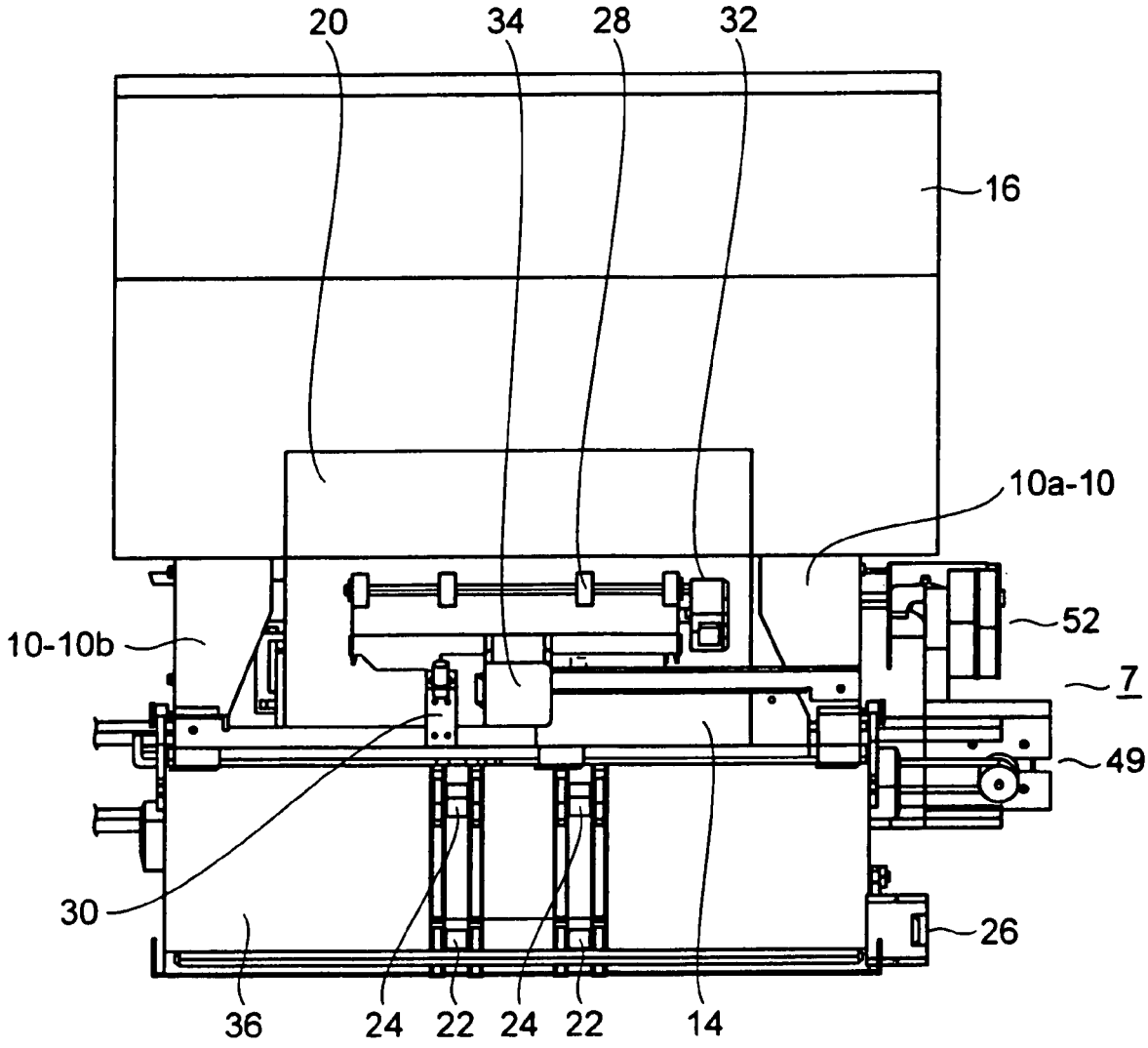
FIG. 2 is a top view showing the essential section of the sheet post-process apparatus of the embodiment of the present invention.
Figure 3:
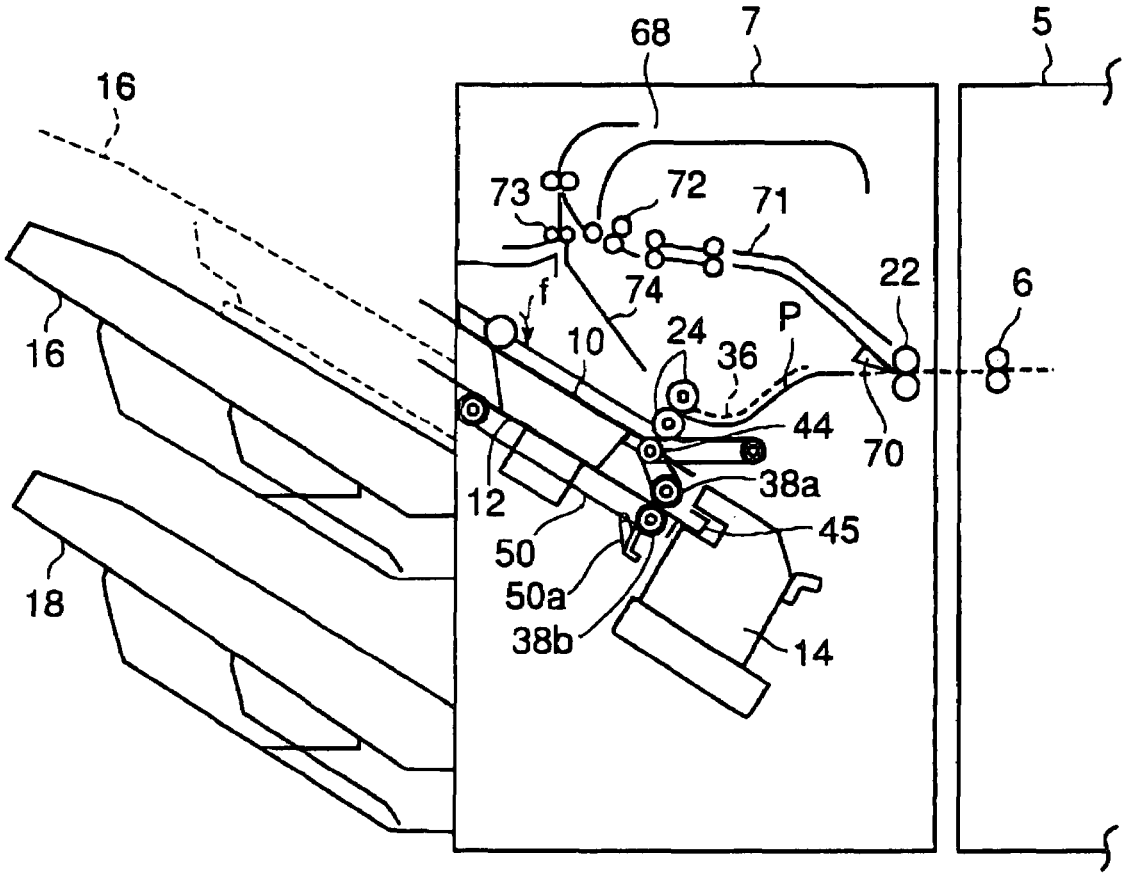
FIG. 3 is a schematic block diagram showing the sheet post-process apparatus of the embodiment of the present invention.

Hereinafter, the embodiment of the present invention will be explained in detail with reference to the accompanying drawings. FIG. 1 is a perspective view showing the essential section of a sheet post-process apparatus 7 of the embodiment of the present invention, and FIG. 2 is a top view showing the essential section of the sheet post-process apparatus, and FIG. 3 is a schematic block diagram showing the sheet post-process apparatus 7 arranged in the neighborhood of an image forming apparatus 5 such as a copier. The sheet post-process apparatus 7 has a pair of entrance rollers 22 for fetching a sheet of paper P on which an image is formed by the image forming apparatus 5 and which is ejected by a pair of paper ejection rollers 6 into the sheet post-process apparatus 7. The entrance rollers 22 are driven by an entrance roller motor 26.

On the downstream side of the entrance rollers 22, a gate 70 which is a first processing mechanism for performing the Z-folding process, which is the first post process, for distributing the sheets of paper P to the side of a Z-folding mechanism 68 for performing the first processing step and to the side of the standby tray 10 for performing the standby step is installed. Between the gate 70 and the Z-folding mechanism 68, a folding path 71 for leading the sheets of paper P to be Z-folded is installed. Between the gate 70 and a standby tray 10, a paper path ceiling 36 for leading the sheets of paper P to a pair of paper feed rollers 24 is installed. Under the standby tray 10, a processing tray 12 for performing the loading step for loading the sheets of paper P dropped and fed from the standby tray 10 is arranged.

Figure 4:
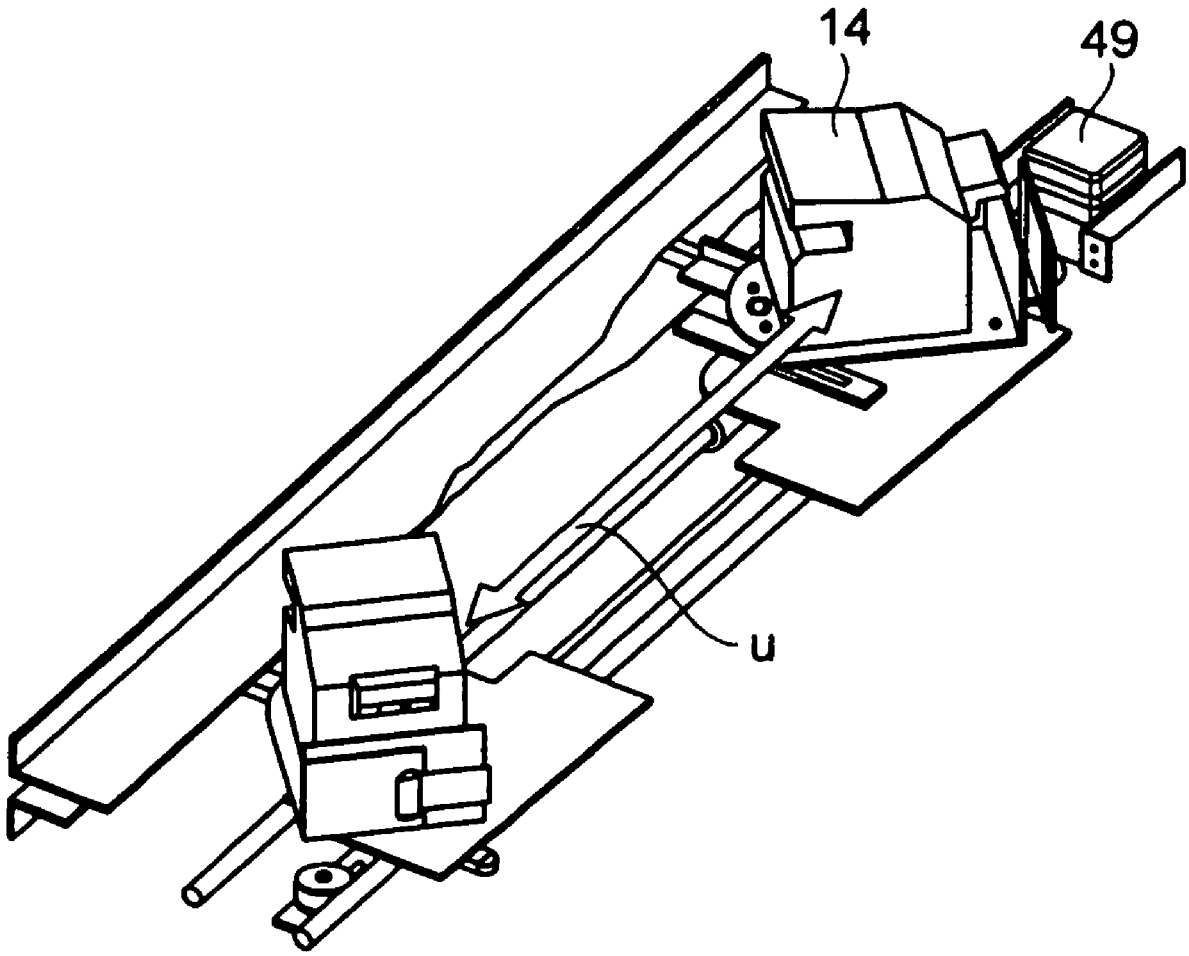
FIG. 4 is a perspective view showing the stapler of the sheet post-process apparatus of the embodiment of the present invention.

The processing tray 12, while the sheets of paper P are stapled by the stapler 14 which is a second processing mechanism for performing the stapling process for performing the second processing step which is the second post-process, matches and supports the sheets of paper P to be loaded. As shown in FIG. 4, the stapler 14 can slide and move in the direction of the arrow u by a stapler driving unit 49 and is rotated, moved, and positioned according to the stapling direction, thus the stapling process is controlled.

Figure 5:
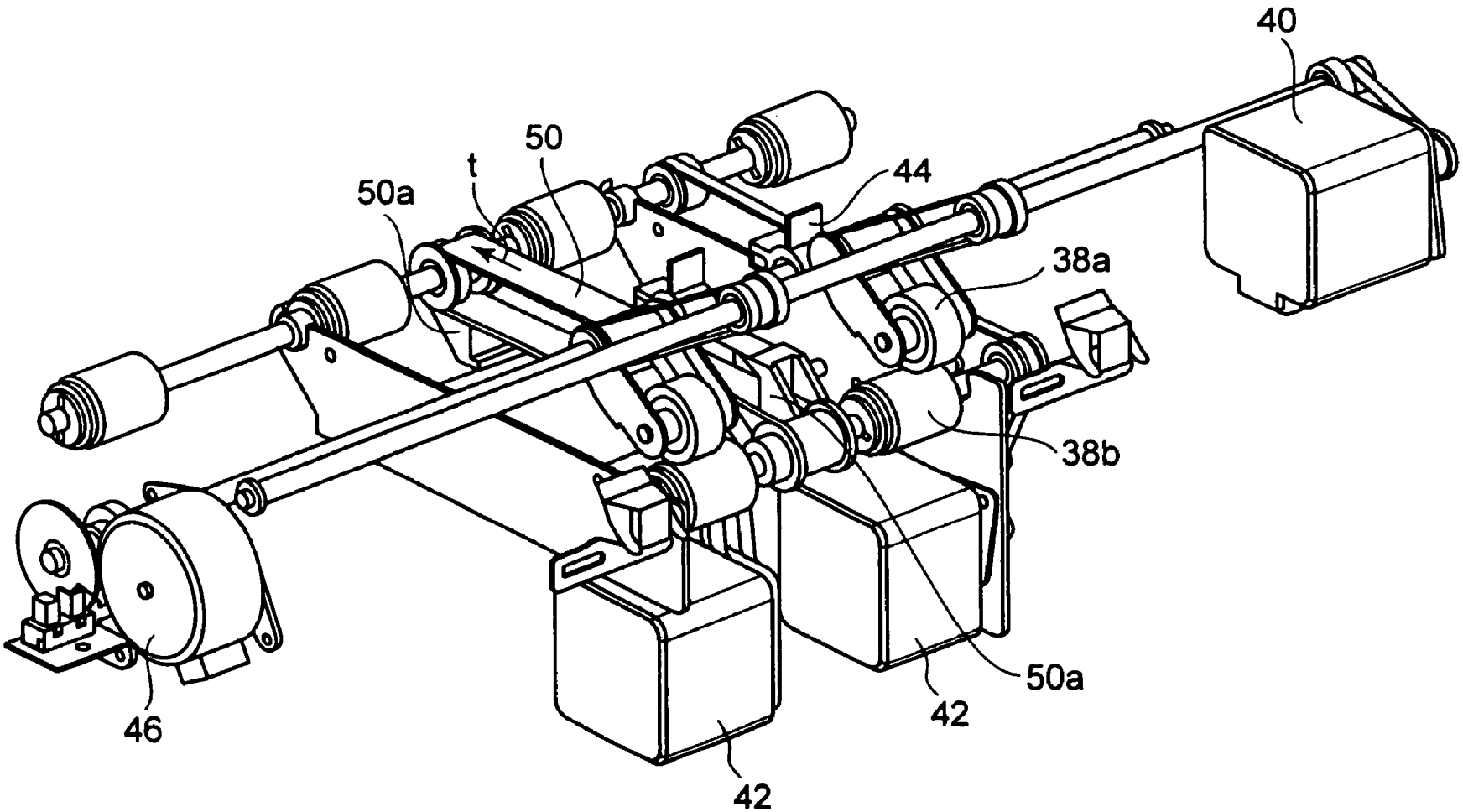
FIG. 5 is a perspective view showing the vertical matching roller of the embodiment of the present invention.

The processing tray 12 has a pair of upper vertical matching roller 38*a* and lower vertical roller 38*b* shown in FIG. 5. The upper vertical matching roller 38*a* and lower vertical roller 38*b* match a plurality of sheets of paper P dropped and fed from the standby tray 10 in the vertical direction which is a conveying direction. The upper and lower vertical matching rollers 38*a* and 38*b* serve as bundle conveying rollers for holding a sheet bundle T after stapled and taking out it from the stapler 14. The upper vertical matching roller 38*a* is driven by a vertical matching upper roller motor 40 and the lower vertical matching roller 38*b* is driven by a vertical matching lower roller motor 42.

Figure 6:
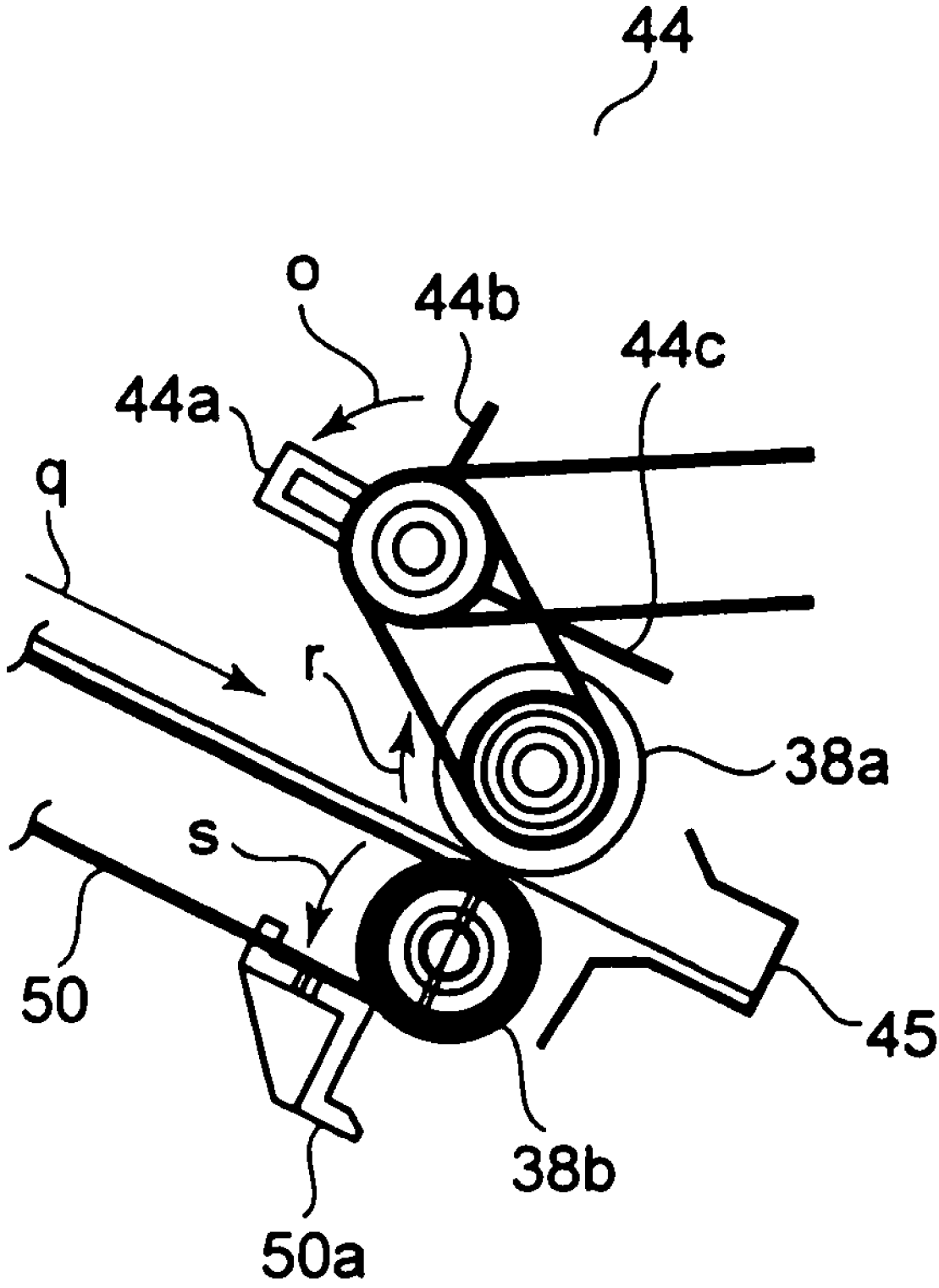
FIG. 6 is an illustration showing the paddle of the embodiment of the present invention.

Further, when the sheets of paper P are dropped and fed on the processing tray 12, at the position where the rear end of each of the sheets of paper P is dropped, a rotatable paddle 44 for matching vertically the uppermost sheet of paper P loaded on the processing tray 12 is arranged. The paddle 44, as shown in FIG. 6, has a receiving portion 44*a* of the sheets of paper P dropped and fed onto the processing tray 12, a beating portion 44*b* for beating down the sheets of paper P on the processing tray 12, and a feeding portion 44*c* for matching the sheets of paper P on the processing tray 12 and it is driven by a paddle motor 46. The paddle 44 is composed of an elastic rubber material.

At the end of the processing tray 12 on the side of the stapler 14, a stopper 45 for making contact with the rear end of each of the sheets of paper P and controlling the rear end position. Almost at the center of the processing tray 12, a conveyor belt 50 which is a conveyor mechanism for making contact with the lowest sheet of paper P on the processing tray 12 is installed. The conveyor belt 50 conveys the sheet bundle T, which is stapled and taken out from the stapler 14 by the upper and lower vertical matching rollers 38*a* and 38*b*, up to the first or second paper ejection tray 16 or 18 which is a paper ejection means. To the conveyer belt 50, a feed pawl 50*a* for hooking the rear end of the sheet bundle T is attached.

Figure 10:
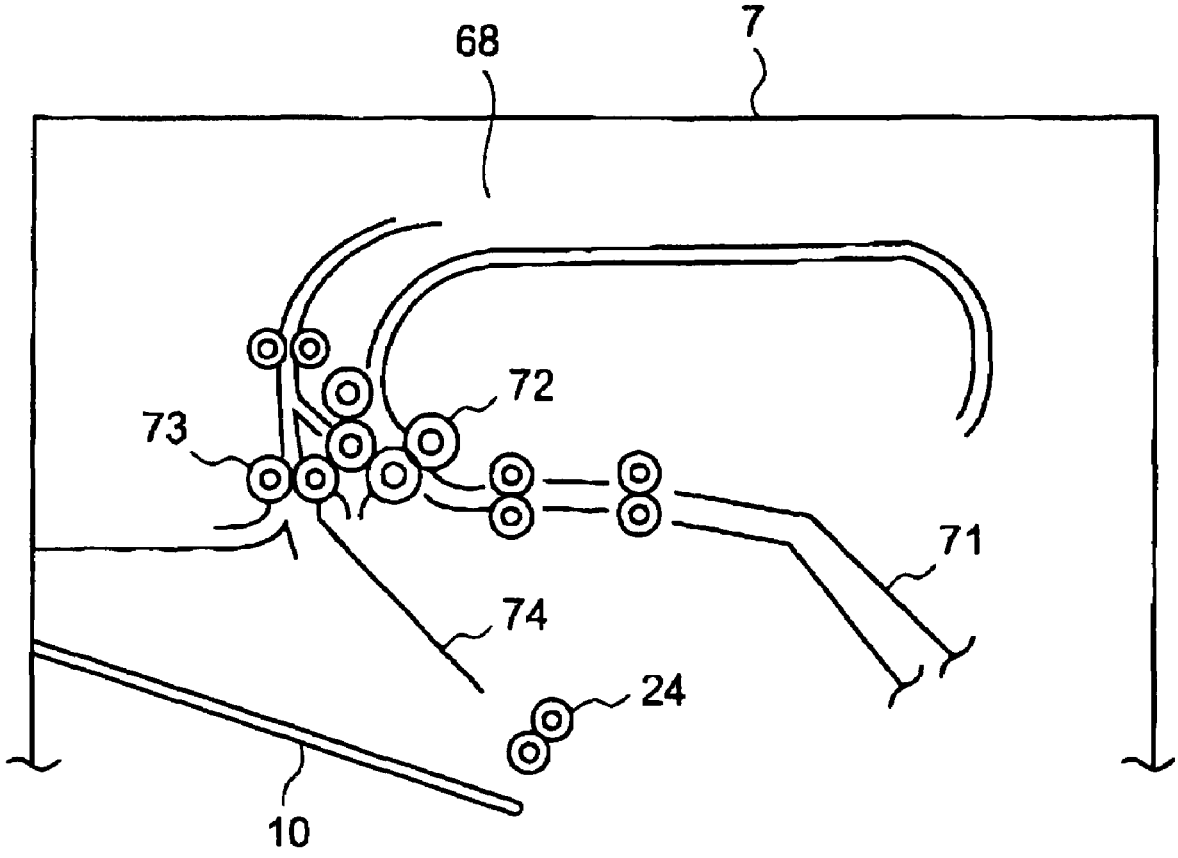
FIG. 10 is an illustration showing feed of sheets of paper from the Z-folding mechanism of the embodiment of the present invention.

A Z-folding mechanism 68 shown in FIG. 10 folds the sheets of paper P taken in from a first pair of feed rollers 72 and can drop and feed them, guided by a drop guide 74, onto the standby tray 10. When the sheets of paper P taken in from the first pair of feed rollers 72 are folded in a Z shape and then are not stapled, they can be conveyed from the second pair of feed rollers 73 toward the first or second paper ejection tray 16 or 18.

The standby tray 10 can drop and feed the sheets of paper P onto the processing tray 12 and also can convey the sheets of paper P toward the first or second paper ejection tray 16 or 18. When conveying the sheets of paper P toward the paper ejection trays 16 and 18, a standby tray roller 28 for matching the sheets of paper P makes contact with the sheets of paper P on the standby tray 10. The standby tray roller 28 is controlled in the vertical movement by a standby tray roller driving source 30 and is driven to rotate by a standby tray roller motor 32.

The standby tray 10 is inclined so that the front end of the sheets of paper P is positioned higher than the rear end thereof. The first or second paper ejection tray 16 or 18 is moved up and down by a paper ejection tray driving unit 52 and either of them is selected. The first or second paper ejection tray 16 or 18 is moved up and down up to almost the same height as that of the standby tray 10 or the processing tray 12 when loading the sheets of paper P to improve the consistency of the sheets of paper P to be ejected. The first or second paper ejection tray 16 or 18 is inclined so that the front end of the sheets of paper P is positioned higher than the rear end thereof.

Figure 7:
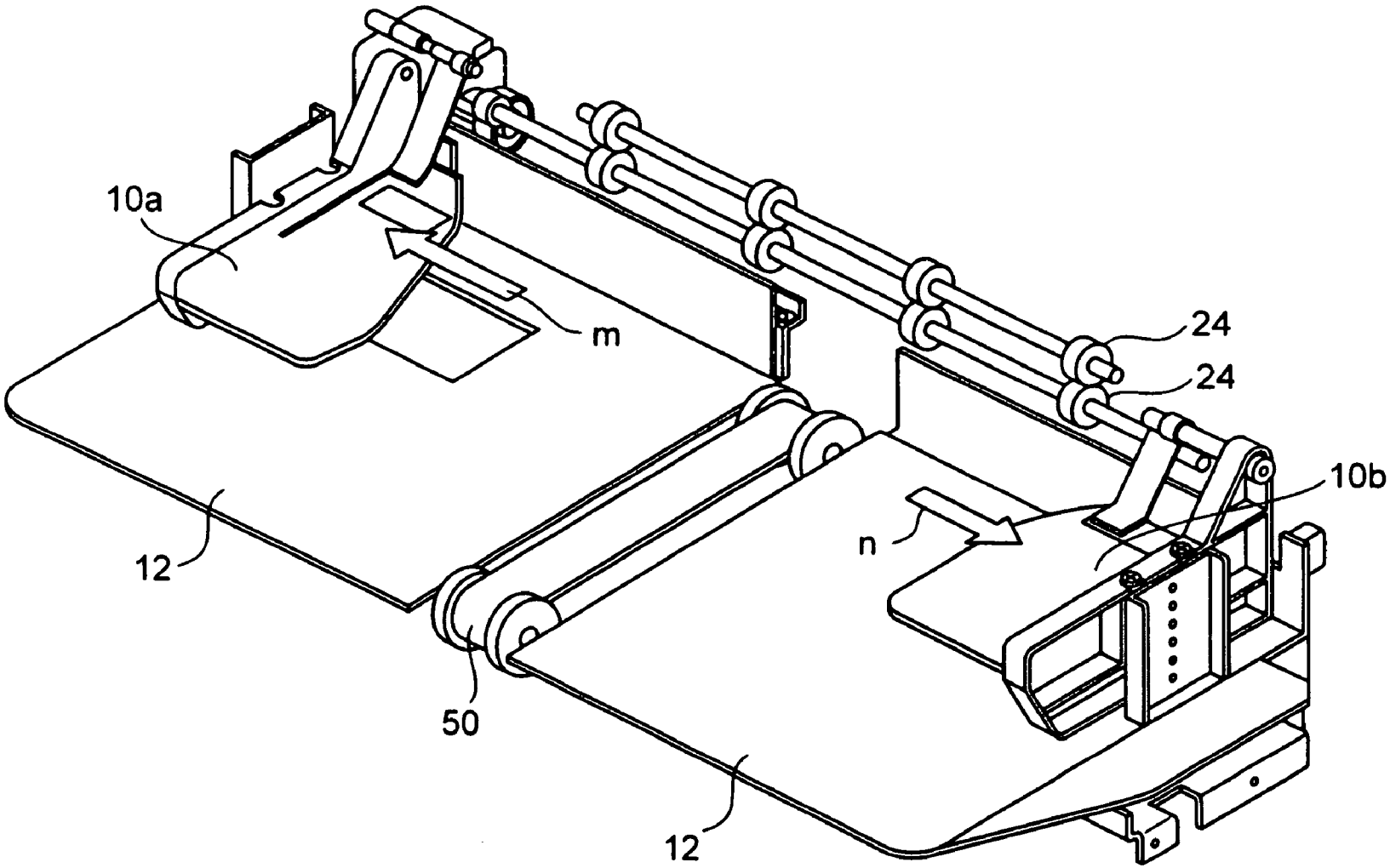
FIG. 7 is a schematic perspective view showing the standby tray and processing tray of the embodiment of the present invention.
Figure 8:
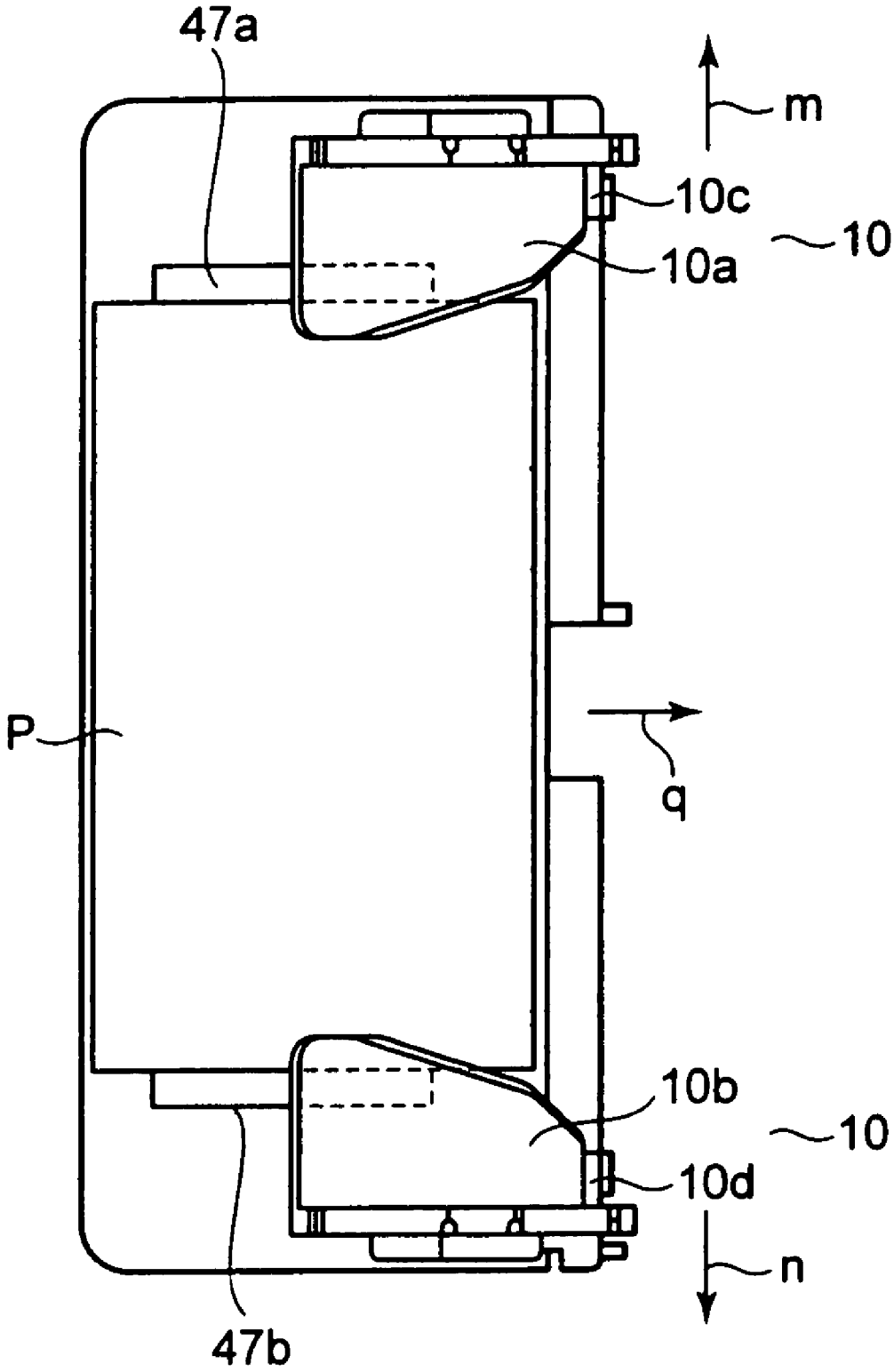
FIG. 8 is a top view showing the standby tray and processing tray of the embodiment of the present invention.
Figure 9:
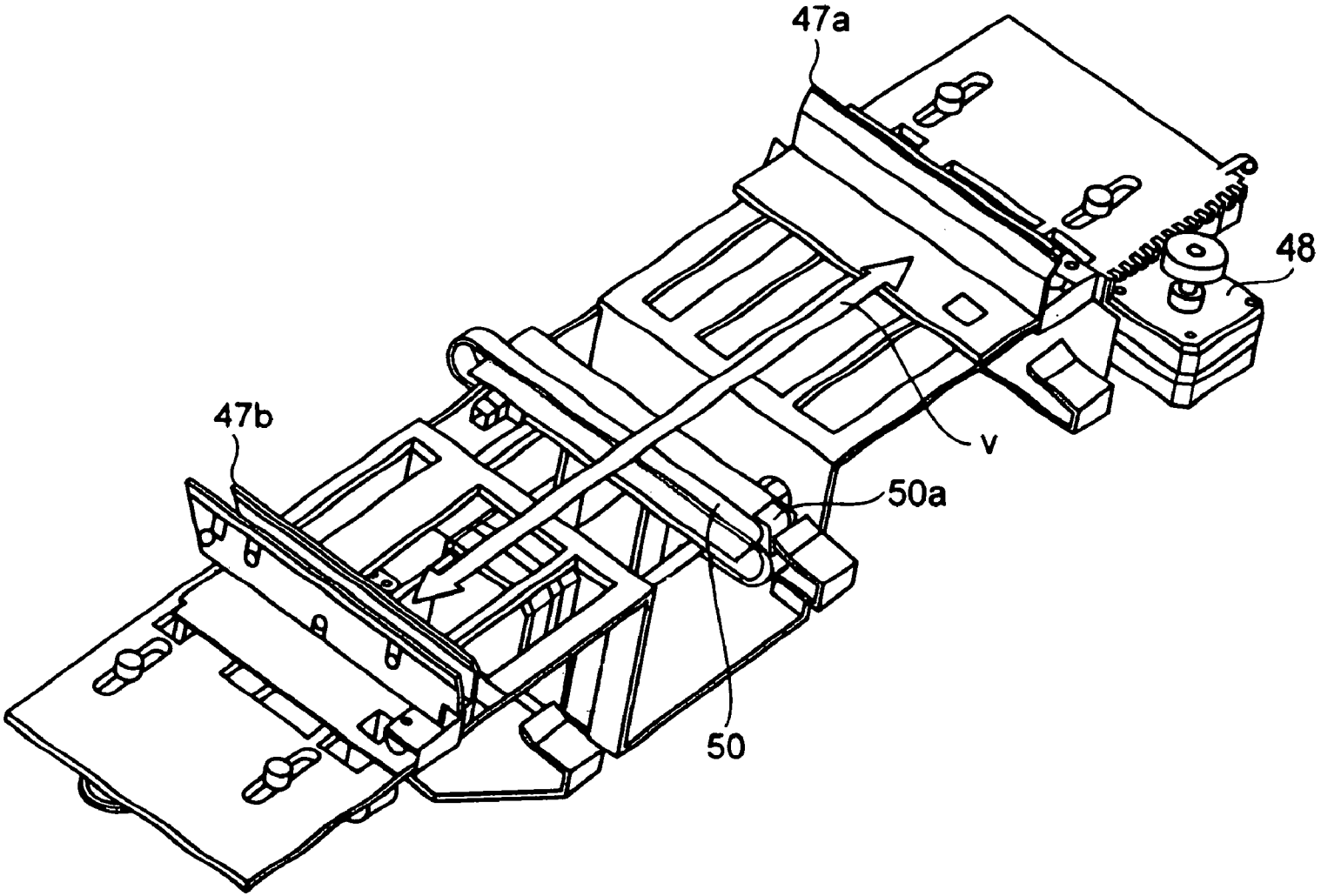
FIG. 9 is a schematic perspective view showing the horizontal matching plate and conveyor belt of the embodiment of the present invention.

As shown in FIGS. 7 and 8, the standby tray 10 has a pair of tray members 10*a* and 10*b*, receives the sheets in a state that it slides in the width of the paper P and supports both sides of the paper P. On the tray members 10*a* and 10*b*, standby stoppers 10*c* and 10*d* for controlling the rear ends of the sheets of paper P are installed. The standby tray 10 slides and moves by the standby tray motor 34. Between the standby tray 10 and the processing tray 12 where it reaches, when dropping and feeding the sheets of paper P from the standby tray 10 onto the processing tray 12, horizontal matching plates 47*a* and 47*b* shown in FIG. 9 for preventing the sheets of paper P from turning away in the horizontal direction perpendicular to the conveying direction and matching them horizontally are installed. The horizontal matching plates 47*a* and 47*b* are formed slidably in the direction of the arrow v so as to fit to the width of the sheets of paper P by a horizontal matching motor 48.

Next, the operation of the invention will be described. When an image is formed by the image forming apparatus 5 and a sheet of paper P is fed from the paper ejection rollers 6, the sheet post-process apparatus 7, depending on a case of performing the post-process of the sheet of paper P or a case of performing no post-process, or while the preceding sheet of paper P is in execution of the post-process or the post-process is finished, performs a different operation.

When the post process is not to be performed, for example, the first paper ejection tray 16 slides and moves to the position indicated by the dotted line shown in FIG. 3 and can load the sheets of paper P ejected from the standby tray 10 in good consistency. When the post process is not to be performed, the sheets of paper P distributed by the gate 70 via the entrance rollers 22 and conveyed to the paper feed rollers 24 via the paper path ceiling 36 are fed to the standby tray 10 by the paper feed rollers 24. Then, the sheets of paper P are dropped onto the standby tray 10, are conveyed by the standby tray roller 28 rotating in the direction of the arrow f, and are ejected to the first paper ejection tray 16.

In this way, on the first paper ejection tray 16, sheets of paper are sequentially loaded. At this time, the first paper ejection tray 16 is inclined so that the front end side of the sheet of paper is positioned higher than the rear end side thereof. Therefore, the preceding sheet of paper P loaded on the first paper ejection tray 16 is not pressed out by making contact with the front end of the succeeding sheet of paper P. Namely, the ejected sheet of paper P is sequentially loaded on the first paper ejection tray 16 unless the order is disturbed. Further, even if the preceding sheet of paper P is pressed by the succeeding sheet of paper P and is slightly displaced, since the tilt angle is formed, the sheet of paper P drops by its own weight and is loaded on the first paper ejection tray 16 with the rear end matched, and the ejection process of the sheet of paper is completed.

Next, when only the Z-folding process which is the first post process is to be performed and the stapling process is not to be performed, the sheets of paper P distributed by the gate 70 via the entrance rollers 22 and conveyed to the first pair of feed rollers via the folding path 71 are folded by the Z-folding mechanism 68 in a Z shape and are ejected to the first paper ejection tray 16 from the second pair of feed rollers 73.

Next, a case that sheets of paper folded in a Z shape, sheets of paper not folded in a Z shape, or sheets of paper composed of both sheets mixed are to be subject to the stapling process and there are no preceding sheets of paper in execution of the stapling process on the processing tray 20 will be described. At this time, the standby tray 10 slides and moves tray members 10*a* and 10*b* respectively to the positions indicated by the dotted lines in FIG. 11 in the direction of the arrow m or the direction of the arrow n and opens the dropping and feeding path of the sheets of paper P. Further, horizontal matching plates 47*a* and 47*b*, to match horizontally the sheets of paper P dropped from the paper feed rollers 24, are arranged so that the interval between the horizontal matching plates 47*a* and 47*b* is made almost equal to the width of the sheets of paper P. By doing this, the sheets of paper P folded in a Z shape and guided by the drop guide 74 from the second pair of feed rollers 73 and the sheets of paper P fed by the paper feed rollers 24 are dropped and fed directly onto the processing tray 12 unless the conveying is disturbed by the standby tray 10.

At the time of dropping and feeding, the upper vertical matching roller 38*a* is shifted upward and the receiving portion 44*a* of the paddle 44 receives the rear end of the sheet of paper P. Both sides of the sheet of paper P drop in contact with the horizontal matching plates 47*a* and 47*b* and are matched in the horizontal direction. Then, the paddle 44 rotates in the direction of an arrow o, drops the rear end of the sheet of paper P from the receiving portion 44*a*, and beats down it onto the processing tray 12 by the beating portion 44*b*. Furthermore, the paddle 44 feeds the sheet of paper P in the direction of an arrow q by the feeding portion 44*c*, and the rear end of the sheet of paper P makes contact with the stopper 45, and the vertical matching of the sheet of paper P is completed.

When matching the sheet of paper P fed by the processing tray 12 on the basis of the stopper 45 like this, the rear end side 50*c* of the sheet of paper P on the conveyor belt 50 is lower than the support face of the sheet of paper P on the processing tray 12. Therefore, the contact friction of the rear end of the lowest sheet of paper P with the conveyor belt is small, and the consistency of the sheets of paper P is not disturbed, and the sheet of paper P is matched surely. Further, the vertical matching of the sheet of paper P on the processing tray 12 may be executed by, instead of the paddle 44, the upper vertical matching roller 38*a* by moving up and down each time.

In this way, the sheets of paper P which an image is formed on and are folded in a Z shape and/or the sheets of paper P fed by the paper feed rollers 24 are loaded directly on the processing tray 12 from the paper feed rollers 24 or the second pair of feed rollers 73 while sequentially matching them in the horizontal direction and vertically direction. When the sheets of paper P reach a predetermined number, the stapler 14 staples the sheets of paper P on the processing tray 12 at a desired position and bundles them to form a sheet bundle T. Hereafter, the upper vertical matching roller 38*a* is moved down onto the sheet bundle and the sheet bundle T is held between the upper vertical matching roller 38*a* rotating in the direction of the arrow r and the lower vertical matching roller 38*b* rotating in the direction of the arrow s and is conveyed toward the first paper ejection tray 16. When the rear end of the sheet bundle T passes the upper and lower vertical matching rollers 38*a* and 38*b*, it is hooked by the feed pawl 50*a* of the conveyor belt 50 rotating in the direction of the arrow t and is fed onto the first paper ejection tray 16.

At this time, the first paper ejection tray 16 slides and moves from the position indicated by the dashed line in FIG. 3 to the position indicated by the solid line. Further, the first paper ejection tray 16 is arranged slantwise and the front end of the sheet of paper is positioned higher than the rear end thereof, so that the preceding sheet of paper P fed onto the first paper ejection tray 16 is not pressed out by making contact with the front end of the succeeding sheet bundle T. Further, even if the preceding sheet bundle T is slightly displaced by the succeeding sheet of paper P, since the tilt angle is formed, the sheet bundle T drops by its own weight and is loaded on the first paper ejection tray 16 with the rear end matched, and the stapling process of the sheets of paper P is completed. The sheet bundle T formed in this way is composed of sheets of paper folded in a Z shape, sheets of paper not folded in a Z shape, or both sheets of paper mixed.

Next, a case that sheets of paper folded in a Z shape, sheets of paper not folded in a Z shape, or both sheets of paper mixed are to be stapled and preceding sheets of paper P in execution of the stapling process remain on the processing tray 12 will be described. At this time, in the standby tray 10, the tray members 10*a* and 10*b* slide and move from the positions indicated by the dotted lines in FIG. 11 respectively in the opposite direction of the direction of the arrow m or in the opposite direction of the direction of the arrow n, and are at the positions indicated by the solid lines shown in FIG. 11. By doing this, the tray members 10*a* and 10*b* can support the sheets of paper P folded in a Z shape and guided by the drop guide 74 from the second pair of feed rollers 73 and the sheets of paper P fed by the paper feed rollers 24. Further, the standby tray roller 28 is shifted above the standby tray 10 not to disturb the sheets of paper P. The sheets of paper P ejected from the image forming apparatus 5 and folded in a Z shape and/or the sheets of paper P fed by the paper feed rollers 24 are loaded once on the standby tray 10 to wait for the processing tray 12 to be free.

The sheets of paper P loaded on the standby tray 10 are moved down onto the standby tray 10, are sent toward the standby stoppers 10*c* and 10*d* by the standby tray roller 28 rotating in the opposite direction of the direction of the arrow f, and are vertically matched with the rear end of the sheets of paper P in contact with the standby stoppers 10*c* and 10*d*. Furthermore, the first paper ejection tray 16 is arranged slantwise so that the front end of the sheets of paper is positioned higher than the rear end thereof, thus the sheets of paper P are vertically matched by the own weight with the rear end thereof in contact with the standby stoppers 10*c* and 10*d*.

Further, the standby tray 10 is arranged slantwise, so that for example, even if the sheet of paper P is fed from the paper feed rollers 24 in a state that it is curled convexly and is fed to the standby tray 10, the preceding sheet of paper P loaded on the standby tray 10 is not pressed out by making contact with the front end of the succeeding sheet of paper P. Namely, the fed sheet of paper P is sequentially loaded on the standby tray 10 unless the order is disturbed. Further, even if the preceding sheet of paper P is pressed by the succeeding sheet of paper P and is slightly displaced, since the tilt angle is formed, the sheet of paper P drops by its own weight down to the position where the rear end thereof makes contact with the standby stoppers 10*c* and 10*d* and is loaded on the standby tray 10 with the rear end matched.

Figure 11:
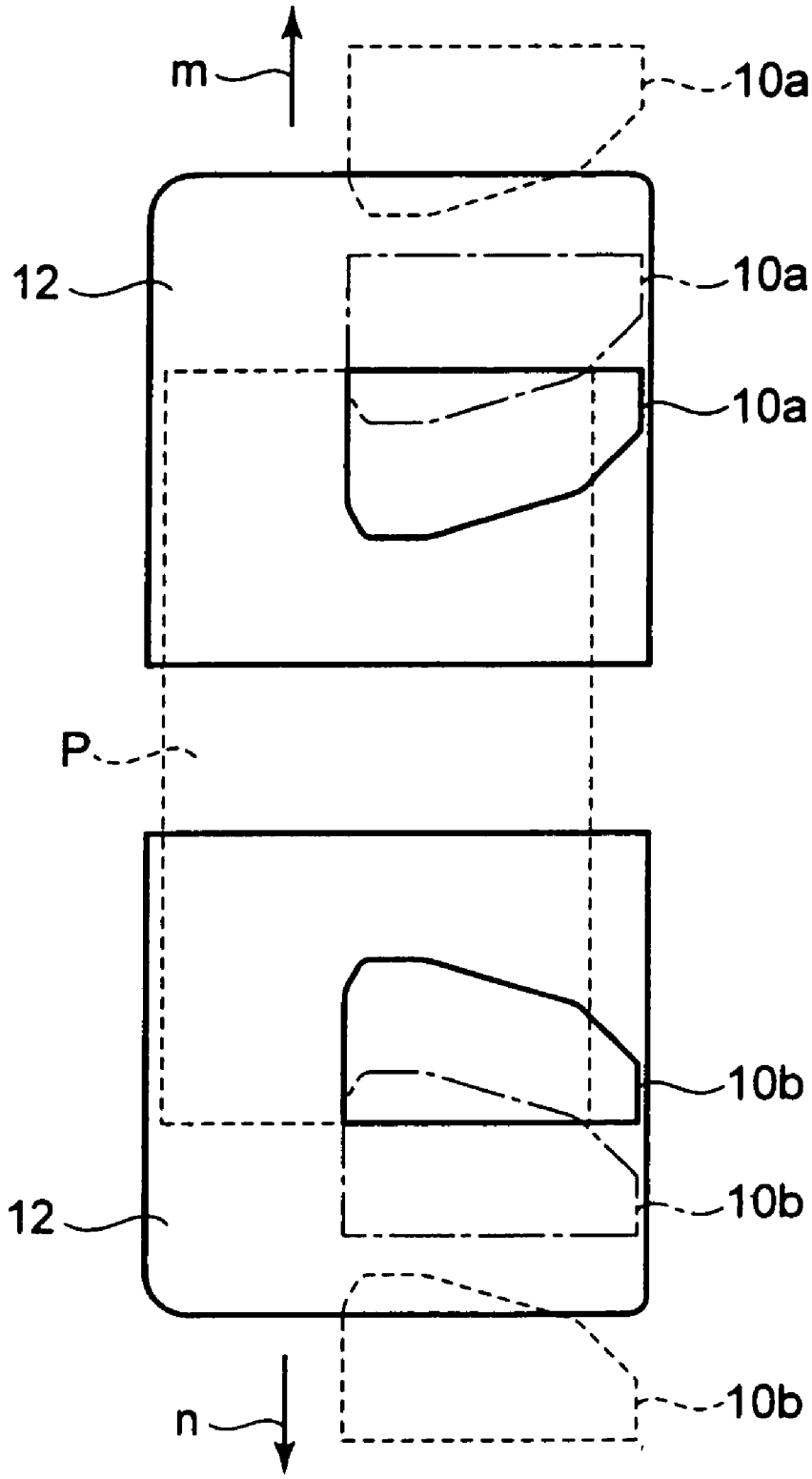
FIG. 11 is an illustration showing movement of the standby tray of the embodiment of the present invention.

During this period, when the preceding sheet of paper P on the processing tray 12 is ejected on the side of the paper ejection tray 16 and the processing tray 12 becomes free, the standby tray 10 slides and moves the tray members 10*a* and 10*b* respectively up to the positions indicated by the dotted lines in FIG. 11 in the directions of the arrows m and n from the positions indicated by the solid lines in FIG. 11 via the positions indicated by the alternate long and short dash line in FIG. 11. By doing this, for example, two sheets of paper P folded in a Z shape standing by on the standby tray 10 and/or the sheets of paper P fed by the paper feed rollers 24, when the tray members 10*a* and 10*b* reach the positions indicated by the alternate long and short dash line in FIG. 11, are dropped and fed onto the processing tray 12 from between the tray members 10*a* and 10*b*. At this time, the horizontal matching plates 47*a* and 47*b* are arranged so as to make the interval between them almost equal to the width of the sheets of paper P. Therefore, the sheets of paper P dropped from the standby tray 10 are controlled on both sides by the horizontal matching plates 47*a* and 47*b* and are matched horizontally.

The lower side sheet of paper P of the two sheets of paper P dropped onto the processing tray 12 is sent in the direction of the arrow q by the lower vertical matching roller 38*b* rotating in the opposite direction of the direction of the arrow s, and the rear end of the sheet of paper P makes contact with the stopper 45, and the vertical matching of the sheet of paper P is completed. The upper side sheet of paper P of the two sheets of paper P dropped onto the processing tray 12 is sent in the direction of the arrow q by the upper vertical matching roller 38*a* rotating in the opposite direction of the direction of the arrow r. By doing this, the rear end of the sheet of paper P makes contact with the stopper 45 and the vertical matching of the sheet of paper P is completed. Thereafter, the upper vertical matching roller 38*a* is shifted upward. When matching the sheet of paper P fed by the processing tray 12 on the basis of the stopper 45 like this, the rear end side 50*c* of the sheet of paper P on the conveyor belt 50 is lower than the support face of the sheet of paper P on the processing tray 12. Therefore, the contact friction of the rear end of the lowest sheet of paper P with the conveyor belt is small, and the consistency of the sheets of paper P is not disturbed, and the sheet of paper P is matched surely.

The sheets of paper P which an image is formed on and are folded in a Z shape by the image forming apparatus 5 and/or the third and subsequent sheets of paper P fed by the paper feed rollers 24 are directly dropped and fed onto the processing tray 12 from between the tray members 10*a* and 10*b* without standing by on the standby tray 10. Hereafter, the third and subsequent sheets of paper P are sequentially matched on the sheets of paper P loaded earlier on the processing tray 12 by the paddle 44.

When the sheets of paper P loaded on the processing tray 12 reach a predetermined number, the sheets are stapled by the stapler 14 to form a sheet bundle T. Hereafter, the sheet bundle T is conveyed toward the first paper ejection tray 16 by the upper and lower vertical matching rollers 38*a* and 38*b*. Furthermore, the sheet bundle T passing through the upper and lower vertical matching rollers 38*a* and 38*b*, after the rear end thereof is hooked by the feed pawl 50*a* of the conveyor belt 50, is conveyed onto the first paper ejection tray 16. The sheet bundle T completed in the stapling process and conveyed onto the paper feed tray 16 in this way is composed of sheets of paper folded in a Z shape, sheets of paper not folded in a Z shape, or both sheets of paper mixed.

According to this embodiment, when the stapling process is to be performed after image forming and the preceding stapling process is not finished on the processing tray 12, the standby tray 10 is installed above the processing tray 12 and waits for the succeeding sheets of paper P. And, waiting for the processing tray 12 to become free, the sheets of paper P standing by on the standby tray 10 are dropped and fed and then are moved to the processing tray 16. Therefore, the practical conveying path from the standby tray 10 in the sheet post-process apparatus 7 to the processing tray 12 can be shortened and the sheet post-process apparatus can be miniaturized.

Further, the Z-folding mechanism 68 is arranged above the standby tray 10 and drops and feeds the sheets of paper P folded in a Z shape onto the standby tray 10 or the processing tray 12, so that even when the Z-folding process is to be performed, the sheet post-process system can be miniaturized. Furthermore, the sheets of paper P folded in a Z shape can be mixed with the sheets of paper P directly fed to the paper feed rollers 24 from the image forming apparatus 5 by the standby tray 10 or the processing tray 12 and can be stapled, so that a hyperfunctioned sheet post-process system, though it is compact, capable of performing various post processes can be realized.

Further, the present invention is not limited to the aforementioned embodiment and can be variously modified within the scope of the present invention. For example, the method for dropping and feeding sheets from the standby tray onto the processing tray is not limited and the standby tray rotates and moves instead of sliding and moving, thus sheets of paper on the standby tray may be dropped and fed onto the processing tray. Further, the first and second processing apparatuses are not limited, and the first processing mechanism, if it is a post process to be performed for sheets, may be a doubling apparatus, and the second processing mechanism may be a hole puncher. Furthermore, in addition to the first and second processing apparatuses, a third processing mechanism for dropping different sheets as a partition onto the standby tray or processing tray is installed above the standby tray and for example, between sheets of paper to be stapled, different sheets may be inserted as a partition.

As described in detail above, according to the present invention, the standby tray for making sheets stand by is installed above the processing tray for performing the post process and the sheets standing by on the standby tray are dropped and fed onto the processing tray. Therefore, in the apparatus, the distances occupied by the standby tray and processing tray can be overlapped, and the practical conveying path from the paper ejection section of the image forming apparatus body to the processing mechanism for performing the post process can be shortened, and the sheet post-process apparatus can be miniaturized.

What is claimed is:

1. A sheet post-process system, comprising:

a Z-folding mechanism configured to perform a Z-fold process for sheets;

a standby tray arranged under the Z-folding mechanism configured to catch the sheets dropped from the Z-folding mechanism, and load other sheets which are provided after the sheets;

a processing tray arranged under the standby tray configured to load the sheets dropped from the standby tray and the sheets which are provided after the sheets dropped from the standby tray and the sheets which are provided after the sheets or the Z-folding mechanism not via the standby tray; and a processing mechanism configured to perform a post process for the sheets loaded on the processing tray before the standby tray drops the other sheets onto the processing tray.

2. The sheet post-process system according to claim 1, wherein the standby tray is composed of at least a pair of tray members for respectively supporting both sides of the sheets and slides and moves the tray members to drop and feed the sheets onto the processing tray.

3. A sheet post-process system, comprising:

a first processing mechanism configured to perform a first post process for sheets;

a standby tray arranged under the first processing mechanism configured to catch the sheets dropped from the first processing mechanism, and load other sheets which are provided after the sheets;

a processing tray arranged under the standby tray configured to load the sheets dropped from the standby tray and the sheets which are provided after the sheets or the first processing mechanism not via the standby tray;

a second processing mechanism configured to perform a second post process for the sheets loaded on the processing tray before the standby tray drops the other sheets onto the processing tray; and a gate configured to branch the sheets to either of the first processing mechanism and to the standby tray.

4. A sheet post-process system, comprising:

a first processing mechanism configured to perform a first post process for sheets;

a standby tray arranged under the first processing mechanism and is composed of at least a pair of tray members for respectively supporting both sides of the sheets configured to catch the sheets dropped from the first processing mechanism, and load other sheets which are provided after the sheets and slides and moves the tray members to drop and feed the sheets onto the processing tray;

a processing tray arranged under the standby tray configured to load the sheets dropped from the standby tray and the sheets which are provided after the sheets or the first processing mechanism not via the standby tray;

a second processing mechanism configured to perform a second post process for the sheets loaded on the processing tray before the standby tray drops the other sheets onto the processing tray; and a gate configured to branch the sheets to either of the first processing mechanism and to the standby tray, wherein the standby tray is moved to a position which does not disturb a dropping of the sheets not to be performed the first post process during the gate branches the sheets to the standby tray and the standby tray drops the sheets onto the processing tray.

5. A sheet post-processing method, comprising:

performing a Z-fold process for sheets by a Z-folding mechanism;

catching the sheets dropped from the Z-folding mechanism, and loading other sheets which are provided after the sheets on a standby tray;

loading the sheets dropped from the standby tray and the sheets which are provided after the sheets or the Z-folding mechanism not via the standby tray on a processing tray; and performing a post process for the sheets loaded on the processing tray, before the standby tray drops the other sheets onto the processing tray.

6. A sheet post-processing method, comprising:

performing a first post process for sheets by a first processing mechanism;

catching the sheets dropped from the first processing mechanism, and loading other sheets which are provided after the sheets on a standby tray;

loading the sheets dropped from the standby tray and the sheets which are provided after the sheets or the first processing mechanism not via the standby tray on a processing tray;

performing a second post process for the sheets loaded on the processing tray, before the standby tray drops the other sheets onto the processing tray; and making branch the sheets to either of the first processing mechanism and to the standby tray.

7. The sheet post-processing method according to claim 6, wherein the standby tray is composed of at least a pair of tray members for respectively supporting both sides of the sheets and slides and moves the tray members to drop and feed the sheets onto the processing tray.

8. A sheet post-processing method, comprising:

performing a first post process for sheets by a first processing mechanism;

catching the sheets dropped from the first processing mechanism, and loading other sheets which are provided after the sheets on a standby tray which is composed of at least a pair of tray members for respectively supporting both sides of the sheets and slides and moves the tray members to drop and feed the sheets onto the processing tray;

performing a second post process for the sheets loaded on the processing tray, before the standby tray drops the other sheets onto the processing tray; and branching the sheets to either of the first processing mechanism and to the standby tray, wherein the standby tray is moved to a position which does not disturb a dropping of the sheets not to be performed the first post process during the gate branches the sheets to the standby tray and the standby tray drops the sheets onto the processing tray.

* * * * *